US005655506A

United States Patent [19]

Hollis

[11] Patent Number: 5,655,506

[45] Date of Patent: Aug. 12, 1997

[54] SYSTEM FOR PREHEATING INTAKE AIR FOR AN INTERNAL COMBUSTION ENGINE

[76] Inventor: Thomas J. Hollis, 5 Roxbury Dr., Medford, N.J. 08055

[21] Appl. No.: 533,471

[22] Filed: Sep. 25, 1995

[51] Int. Cl.[6] ..... F02G 5/00; F02M 15/00; F02M 23/14

[52] U.S. Cl. ..... 123/556

[58] Field of Search ..... 123/556, 41.31, 123/542

[56] References Cited

U.S. PATENT DOCUMENTS

| | | | |
|---|---|---|---|
| 3,397,684 | 8/1968 | Scherenberg . | |
| 3,450,109 | 6/1969 | Gratzmuller . | |
| 4,079,715 | 3/1978 | Masaki et al. . | |
| 4,212,270 | 7/1980 | Nakanishi et al. . | |
| 4,258,676 | 3/1981 | Lamm | 123/556 |
| 4,286,551 | 9/1981 | Blitz . | |
| 4,338,891 | 7/1982 | Blitz . | |
| 4,348,991 | 9/1982 | Stang et al. . | |
| 4,399,774 | 8/1983 | Tsutsumi . | |
| 4,565,175 | 1/1986 | Kaye . | |
| 4,625,910 | 12/1986 | Kawamura | 123/556 |
| 4,944,260 | 7/1990 | Shea et al. | 123/556 |
| 5,094,198 | 3/1992 | Trotta et al. | 123/556 |
| 5,138,987 | 8/1992 | Schmid et al. | 123/556 |
| 5,170,755 | 12/1992 | Kano et al. . | |
| 5,213,086 | 5/1993 | Sims | 123/556 |
| 5,307,780 | 5/1994 | Dodge | 123/556 |
| 5,347,966 | 9/1994 | Mahon et al. | 123/556 |
| 5,415,147 | 5/1995 | Nagle et al. . | |
| 5,482,013 | 1/1996 | Andrews et al. | 123/556 |

FOREIGN PATENT DOCUMENTS

| | | |
|---|---|---|
| 34 35 833 | 4/1986 | Germany . |
| 35 16 502 | 11/1986 | Germany . |
| 40 33 261 | 4/1992 | Germany . |

OTHER PUBLICATIONS

Sensor Technology Review, *Automotive Engineering*, Sept. 1995, p. 45.

*Primary Examiner*—Marguerite McMahon
*Attorney, Agent, or Firm*—Seidel, Gonda, Lavorgna & Monaco, PC

[57] ABSTRACT

A temperature control system in an internal combustion engine includes a heating arrangement which channels a flow of temperature control fluid from an engine to and from a heat exchanger used to preheat intake air flowing to an engine intake manifold when the ambient air temperature is relatively cold (e.g., below 20° F.). In one embodiment, the heat exchanger is mounted upstream from a throttle body. The heat exchanger consists of a panel of high capacity heat transferring fins, which are heated by heat conductive tubes wrapped around the periphery of the panel. Flow of temperature control fluid to and from the heat exchanger is regulated by a control valve which is controlled by an engine computer unit in accordance with a set of predetermined values which define a curve that is a function of engine oil temperature and ambient air temperature.

13 Claims, 3 Drawing Sheets

SYSTEM FOR PREHEATING INTAKE AIR FOR AN INTERNAL COMBUSTION ENGINE

CROSS-REFERENCE TO RELATED APPLICATIONS

This application is related to U.S. application Ser. No. 08/390,711, filed Feb. 17, 1995 and entitled "SYSTEM FOR MAINTAINING ENGINE OIL AT AN OPTIMUM TEMPERATURE," now abandoned, which is a continuation-in-part of U.S. Pat. No. 5,467,745 issued Nov. 21, 1995 and entitled "SYSTEM FOR DETERMINING THE APPROPRIATE STATE OF A FLOW CONTROL VALVE AND CONTROLLING ITS STATE." The entire disclosures of application Ser. No. 08/390,711 and U.S. Pat. No. 5,467,745 are incorporated herein by reference. This application is also related to U.S. Pat. No. 5,458,096 issued Oct. 17, 1995 and entitled "HYDRAULICALLY OPERATED ELECTRONIC ENGINE TEMPERATURE CONTROL VALVE." The entire disclosure of U.S. Pat. No. 5,458,096 is also incorporated herein by reference. This application is also related to U.S. Pat. No. 5,503,118 issued Apr. 2, 1996 and entitled "INTEGRAL WATER PUMP/ENGINE BLOCK BYPASS COOLING SYSTEM," co-pending U.S. application Ser. No. 08/447,468, filed May 23, 1995 and entitled "SYSTEM FOR HEATING TEMPERATURE CONTROL FLUID USING THE ENGINE EXHAUST MANIFOLD," and U.S. Pat. No. 5,507,251 issued Apr. 16, 1996 and entitled "SYSTEM FOR DETERMINING THE LOAD CONDITION OF AN ENGINE FOR MAINTAINING OPTIMUM ENGINE OIL TEMPERATURE." The entire disclosures of application Ser. No. 08/447,468, U.S. Pat. No. 5,503,118 and U.S. Pat. No. 5,507,251 are incorporated herein by reference.

FIELD OF THE INVENTION

This invention relates to a system for preheating intake air flowing through an intake manifold of an internal combustion engine.

BACKGROUND OF THE INVENTION

Page 169 of the *Goodheart-Willcox Automotive Encyclopedia*, The Goodheart-Willcox Company, Inc., South Holland, Ill., 1995 describes that as fuel is burned in an internal combustion engine, about one-third of the heat energy in the fuel is converted to power. Another third goes out the exhaust pipe unused, and the remaining third must be handled by a cooling system. This third is often underestimated and even less understood.

Most internal combustion engines employ a pressurized cooling system to dissipate the heat energy generated by the combustion process. The cooling system circulates water or liquid coolant through a water jacket which surrounds certain parts of the engine (e.g., block, cylinder, cylinder head, pistons). The heat energy is transferred from the engine parts to the coolant in the water jacket. In hot ambient air temperature environments, or when the engine is working hard, the transferred heat energy will be so great that it will cause the liquid coolant to boil (i.e., vaporize) and destroy the cooling system. To prevent this from happening, the hot coolant is circulated through a radiator well before it reaches its boiling point. The radiator dissipates enough of the heat energy to the surrounding air to maintain the coolant in the liquid state.

In cold ambient air temperature environments, especially below zero degrees Fahrenheit, or when a cold engine is started, the coolant rarely becomes hot enough to boil. Thus, the coolant does not need to flow through the radiator. Nor is it desirable to dissipate the heat energy in the coolant in such environments since internal combustion engines operate most efficiently and pollute the least when they are running relatively hot. A cold running engine will have significantly greater sliding friction between the pistons and respective cylinder walls than a hot running engine because oil viscosity decreases with temperature. A cold running engine will also have less complete combustion in the engine combustion chamber and will build up sludge more rapidly than a hot running engine. In an attempt to increase the combustion when the engine is cold, a richer fuel is provided. All of these factors lower fuel economy and increase levels of hydrocarbon exhaust emissions.

To avoid running the coolant through the radiator, coolant systems employ a thermostat. The thermostat operates as a one-way valve, blocking or allowing flow to the radiator. U.S. Pat. No. 4,545,333 shows a typical prior art thermostat controlled coolant system. Most prior art coolant systems employ wax pellet type or bimetallic coil type thermostats. These thermostats are self-contained devices which open and close according to precalibrated temperature values.

Coolant systems must perform a plurality of functions, in addition to cooling the engine parts. In cold weather, the cooling system must deliver hot coolant to heat exchangers associated with the heating and defrosting system so that the heater and defroster can deliver warm air to the passenger compartment and windows. The coolant system must also deliver hot coolant to the intake manifold to heat incoming air destined for combustion, especially in cold ambient air temperature environments, or when a cold engine is started. Ideally, the coolant system should also reduce its volume and speed of flow when the engine parts are cold so as to allow the engine to reach an optimum hot operating temperature. Since one or both of the intake manifold and heater need hot coolant in cold ambient air temperatures and/or during engine start-up, it is not practical to completely shut off the coolant flow through the engine block.

Practical design constraints limit the ability of the coolant system to adapt to a wide range of operating environments. For example, the heat removing capacity is limited by the size of the radiator and the volume and speed of coolant flow. The state of the self-contained prior art wax pellet type or bimetallic coil type thermostats is typically controlled only by coolant temperature.

Numerous proposals have been set forth in the prior art to more carefully tailor the coolant system to the needs of the vehicle and to improve upon the relatively inflexible prior art thermostats. These prior art designs, however, have not controlled the circulation of the coolant so as to efficiently heat the engine.

The goal of all engine cooling systems is to maintain the internal engine temperature as close as possible to a predetermined optimum value. Since engine coolant temperature generally tracks internal engine temperature, the prior art approach to controlling internal engine temperature control is to control engine coolant temperature. Many problems arise from this approach. For example, sudden load increases on an engine may cause the internal engine temperature to significantly exceed the optimum value before the coolant temperature reflects this fact. If the thermostat is in the closed state just before the sudden load increase, the extra delay in opening will prolong the period of time in which the engine is unnecessarily overheated.

Another problem occurs during engine start-up or warm-up. During this period of time, the coolant temperature rises more rapidly than the internal engine temperature. Since the thermostat is actuated by coolant temperature, it often opens before the internal engine temperature has reached its optimum value, thereby causing coolant in the water jacket to prematurely cool the engine. Still other scenarios exist where the engine coolant temperature cannot be sufficiently regulated to cause the desired internal engine temperature.

When the internal engine temperature is not maintained at an optimum value, the engine oil will also not be at the optimum temperature. Engine oil life is largely dependent upon wear conditions. Engine oil life is significantly shortened if an engine is run either too cold or too hot. As noted above, a cold running engine will have less complete combustion in the engine combustion chamber and will build up sludge more rapidly than a hot running engine. The sludge contaminates the oil. A hot running engine will prematurely break down the oil. Thus, more frequent oil changes are needed when the internal engine temperature is not consistently maintained at its optimum value.

Prior art cooling systems also do not account for the fact that the optimum oil temperature varies with ambient air temperature. As the ambient air temperature declines, the internal engine components lose heat more rapidly to the environment and there is an increased cooling effect on the internal engine components from induction air. To counter these effects and thus maintain the internal engine components at the optimum operating temperature, the engine oil should be hotter in cold ambient air temperatures than in hot ambient air temperatures. Current prior art cooling systems cannot account for this difference because the cooling system is responsive only to coolant temperature.

Prior art cooling systems have also not taken full advantage of the heat generated during combustion of the air/fuel mixture. As discussed above, approximately one third of heat generated during the combustion of the fuel/air mixture is transferred through the exhaust system. Several prior art systems have attempted to utilize this heat for improving the efficiency of an engine. For example, U.S. Pat. No. 4,079,715 discloses a prior art method for using exhaust gases to heat the intake air. Special exhaust passageways are attached to the exhaust manifold and direct the exhaust gases through or adjacent to the intake manifold thereby permitting convection of the exhaust gas heat to the intake air.

A second prior art method for utilizing the heat in the exhaust gases is disclosed on page 229 of the *Goodheart-Willcox Automotive Encyclopedia*, The Goodheart-Willcox Company, Inc., South Holland, Ill., 1995. This method requires the incorporation of a special duct or "crossover passage" around the exhaust manifold that traps the heat which is otherwise dissipated. This trapped heated air is then routed to the intake manifold where it preheats the intake air.

These prior art methods all require the addition of special, relatively heavy ducting which must be designed to be thermally compatible with the temperatures in the exhaust gases.

Also, the prior art methods often create the unwanted condition discussed below. In a typical internal combustion engine, it is ideal to heat the air entering the intake manifold to about 120 degrees Fahrenheit. Heating the intake air to temperatures higher than about 130 degrees Fahrenheit reduces combustion efficiency. This is due to the fact that air expands as it is heated. Consequently, as the air volume expands, the number of oxygen molecules per unit volume decreases. Since combustion requires oxygen, reducing the amount of oxygen molecules in a given volume decreases combustion efficiency. Prior art cooling jackets typically deliver coolant through the intake manifold at all times. When an engine is running hot, the coolant temperature is typically in a range from about 220 to about 260 degrees Fahrenheit. Thus, the coolant may be significantly hotter than the ideal temperature of the intake manifold. Nevertheless, prior art cooling systems continue to deliver hot coolant through the intake manifold, thereby maintaining the intake manifold temperature in an excessively high range.

Also, the prior art systems do not sense ambient air temperature, and therefore do not determine when it is desirable to preheat the intake air. Although preheating intake combustion air is not beneficial in all environments, preheating the air in relatively cold ambient temperature environments (e.g., below 20° F.) provides many benefits, including improved fuel economy, reduced emissions and the creation of a supercharging effect.

U.S. Pat. No. 3,397,684 discloses a supercharged diesel engine with a combustion air cooler for removing the heat of compression of the supercharger and a preheater for heating all of the combustion air within the cooler heat exchanger for cold weather starting and initial operation. In order to heat up the combustion air of the engine during starting of the engine, a heating apparatus is interconnected into the engine cooling liquid circulatory system.

While many of the prior art systems address the problem of cooling an internal combustion engine, none have provided a workable, cost efficient system. Accordingly, a need therefore exists for a system which optimally controls the flow of a fluid in a cooling system and which requires minimal modifications to the current engine arrangement.

SUMMARY OF THE INVENTION

The present invention provides systems and methods for controlling the temperature of a liquid cooled internal combustion engine. The systems disclosed utilize a novel heating arrangement which controls the flow of temperature control fluid to and from an exhaust heat assembly located adjacent to an the engine exhaust manifold. The disclosed systems also utilize another novel heating arrangement which controls the flow of temperature control fluid to and from a heat exchanger used to preheat intake air flowing to the engine intake manifold when the ambient air temperature is relatively cold (e.g., below 20° F.).

The system for preheating intake air incorporates an exhaust heat assembly located adjacent to the exhaust manifold and adapted to receive a flow of temperature control fluid from a water pump. A heat exchanger is mounted between an air cleaner and a throttle body on the engine. The heat exchanger is adapted to receive a flow of intake air. The heat exchanger also receives a flow of heated temperature control fluid from the exhaust heat assembly. The flow of the fluid to and from the heat exchanger is controlled using a set of predetermined temperature control values.

The temperature control fluid leaving the heat exchanger is discharged into a passageway leading to the oil pan. Engine oil temperature is measured in the oil pan or elsewhere in the engine by a first sensor. The temperature of ambient air is measured by a second sensor.

The sensors measure the temperatures of ambient air and engine oil and provide signals to an engine computer. Using a set of predetermined values which define a curve which is a function of engine oil temperature and ambient air temperature, the computer sends signals to a control valve, such as a solenoid actuated valve, which regulates the flow of temperature control fluid to and from the heat exchanger.

The temperature control fluid may also be used to heat the fuel line.

The system may include a third sensor for sensing the temperature of the flow of intake air downstream of the heat exchanger. The sensor provides a signal to the engine computer, which provides further signals to the control valve in accordance with a predetermined value to further regulate the state of the control valve.

The foregoing and other features and advantages of the present invention will become more apparent in light of the following detailed description of the preferred embodiments thereof, as illustrated in the accompanying figures.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DESCRIPTION OF THE PREFERRED EMBODIMENTS

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

Certain terminology is used herein for convenience only and is not be taken as a limitation on the invention. Particularly, words such as "upper," "lower," "left," "right," "horizontal," "vertical," "upward," and "downward" merely describe the configuration shown in the figures. Indeed, the valves and related components may be oriented in any direction. For example, while a vertically oriented radiator is illustrated in the figures, a horizontally oriented radiator is well within the scope of the invention. The terms "inhibiting" and "restricting" are intended to cover both partial and full prevention of fluid flow.

Figure 1:
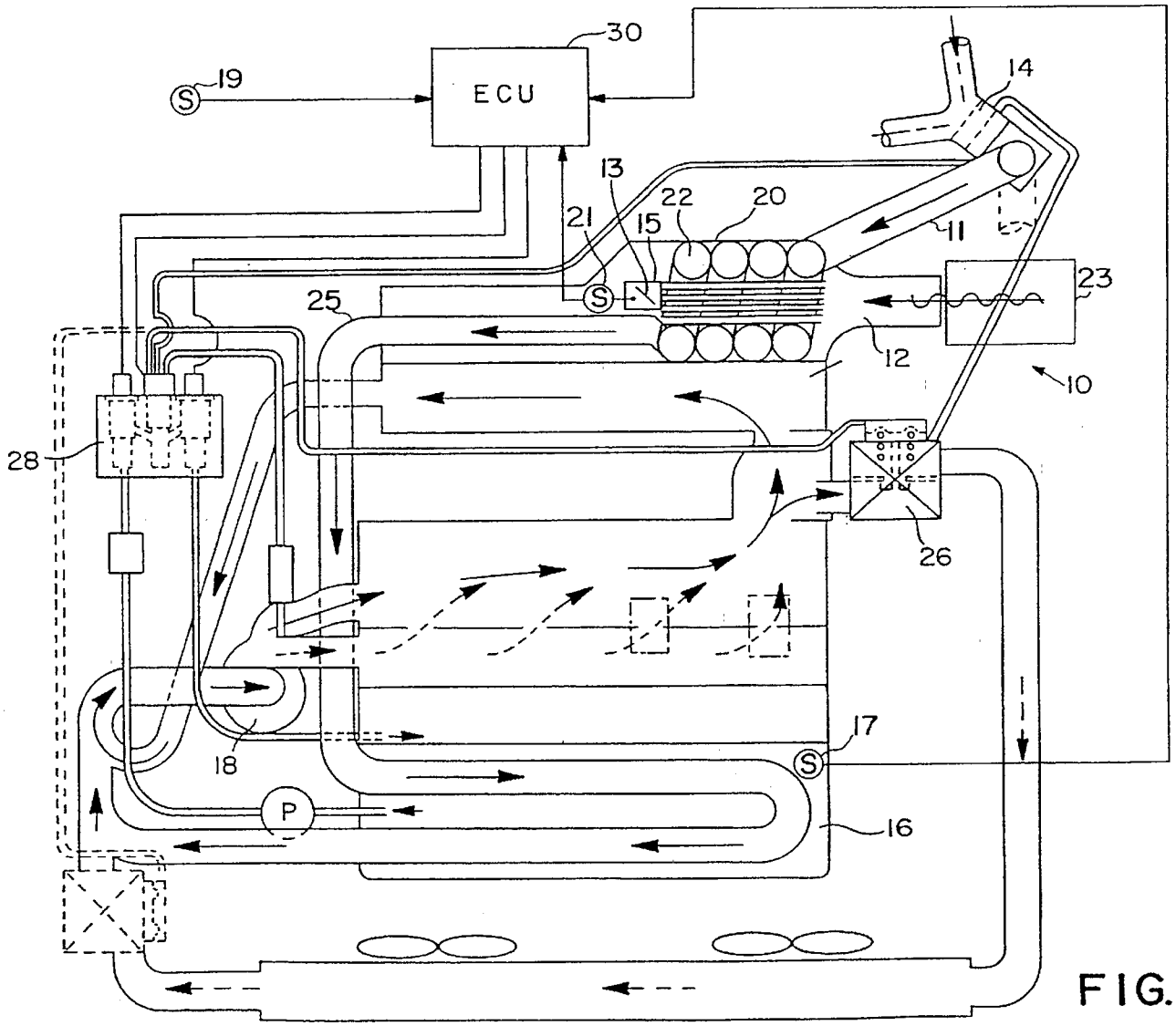
FIG. 1 is a diagrammatical side view of the flow circuit of the temperature control fluid through the exhaust manifold, the intake air heat exchanger, the oil pan, the water pump and the engine.

FIG. 1 illustrates the system 10 for preheating intake air flowing through an intake manifold 12 of an internal combustion engine, which includes an exhaust manifold (not shown), an oil pan 16, a fuel line (not shown) and a water pump 18 which directs a flow of temperature control fluid into the engine. The engine includes an exhaust heat assembly (not shown) located adjacent to the exhaust manifold, which receives a flow of temperature fluid from the water pump 18. The temperature control fluid absorbs heat energy from the exhaust manifold and, hence, increases in temperature as it passes through the assembly. An exemplary embodiment of the exhaust heat assembly is disclosed in a related application, Ser. No. 08/447,468, entitled "SYSTEM FOR HEATING TEMPERATURE CONTROL FLUID USING THE ENGINE EXHAUST", which has been incorporated by reference. The heated temperature control fluid is then channeled along at least one conduit 11 to a heat exchanger 20, where heat energy is transferred to the intake air.

The intake air enters the engine through the air cleaner 23 and is channeled to the intake manifold 12. A throttle valve 13 located within a throttle body 15 regulates the air flow.

In the preferred embodiment, heat energy is transferred to the intake air as it flows through the heat exchanger 20 mounted to the engine within the flow of intake air, preferably between the air cleaner 23 and the throttle body. In alternate embodiments, the heat exchanger 20 can be mounted in the air cleaner 23 or downstream of the throttle body 15.

The heat exchanger 20 consists of a panel of high capacity heat transferring aluminum fins which allow a laminar flow of the intake air as it passes through. The fins are heated by heat conductive tubes 22 made of aluminum or copper, which are wrapped around the periphery of the panel. Temperature control fluid circulates through the tubes 22 when the ambient air temperature falls below a predetermined value (e.g., 20° F.). Heat energy is transferred from the temperature control fluid to the fins where it is transmitted into the passing flow of air. This results in the heating of the intake air. The fuel line may also be heated with the conduit 11 or conduit 26 carrying temperature control fluid flowing to or from the heat exchanger 20.

When the temperature control fluid discharges from the tubes 22 of the heat exchanger 20, it flows through the oil pan 16 and to the water pump 18 for recirculation through the engine. The flow of the temperature control fluid to the heat exchanger 20 is preferably regulated by opening and dosing a temperature control valve 14, such as a hydraulically actuated valve.

In the preferred embodiment, the control valve 14 is an electronically controlled valve. The actuation of the control valve 14 is achieved by means of a hydraulic solenoid injector system 28. Control signals for opening and closing the control valve 14 to regulate flow of the temperature control fluid to and from the heat exchanger 20 are produced by an engine computer unit (ECU) 30.

Figure 2:
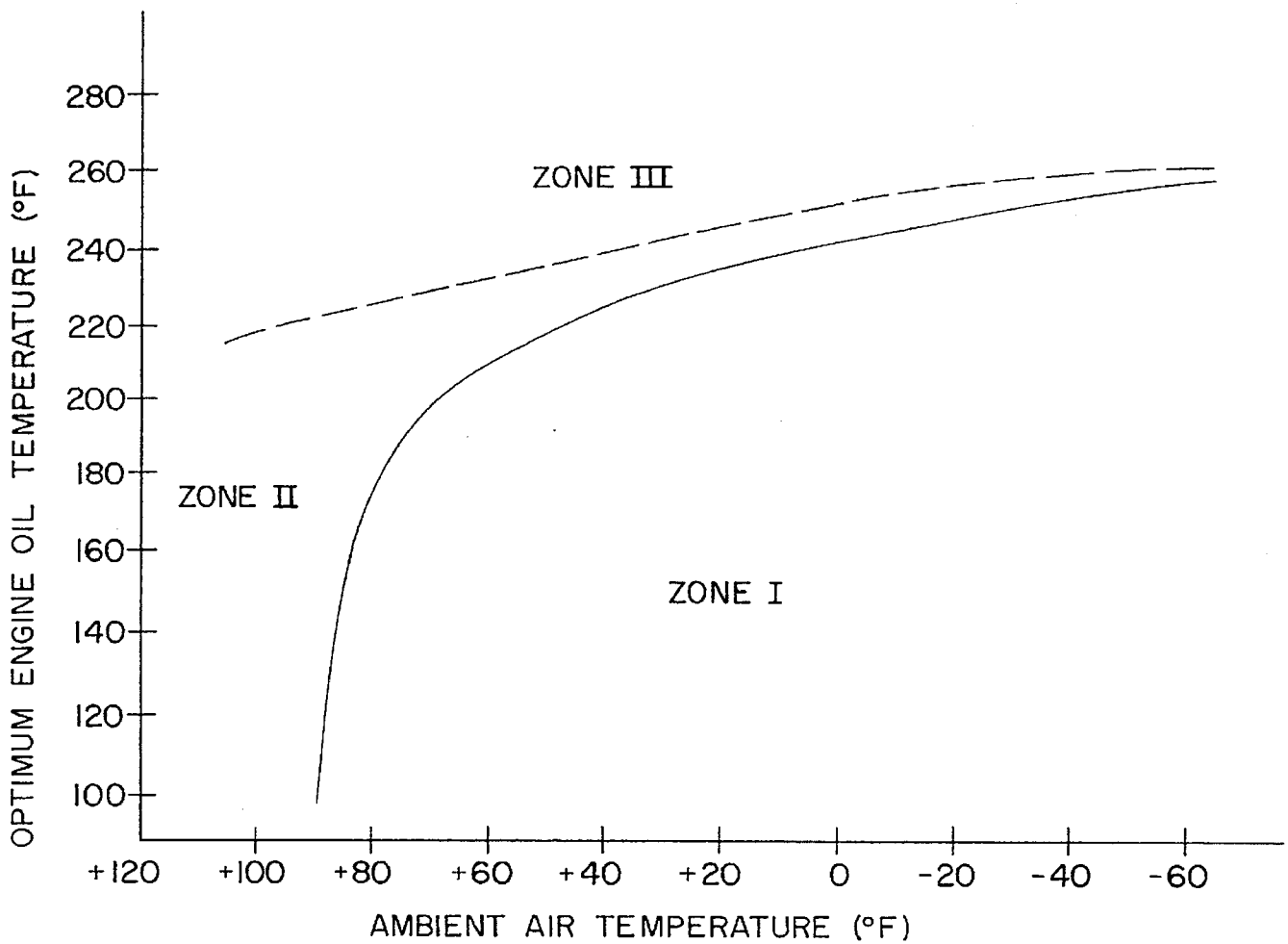
FIG. 2 is an embodiment of the temperature control curves used in controlling the opening and closing of the valves in the present invention.

The control signals of the ECU 30 are produced in accordance with a set of predetermined values which define a curve. At least a portion of the curve has a non-zero slope. The lower curve (solid line) in FIG. 2 illustrates one preferred embodiment of the curve. In this embodiment, the curve is a function of engine oil temperature and ambient air temperature. The upper curve in FIG. 2 (broken line) illustrates a control curve used in the positioning of the EETC valve 26. One embodiment of the upper curve is disclosed in a related application, Ser. No. 08/390,711, filed Feb. 17, 1995 and entitled "SYSTEM FOR MAINTAINING ENGINE OIL AT AN OPTIMUM TEMPERATURE."

Three "zones" are defined in FIG. 2. In Zone I, the exhaust manifold by-pass is "open" and the EETC valve 26 is "closed". In Zone II, both the exhaust manifold by-pass and the EETC valve 26 are "closed". In Zone III, the EETC valve 26 is "open".

Actual engine oil temperature is detected by a sensor 17, which may be located in the oil pan 16 or elsewhere, and which provides a signal to the ECU 30. A second sensor 19 detects ambient air temperature and provides a signal to the ECU 30. The ECU 30 compares the detected oil temperature and the detected ambient air temperature to the predetermined control values in FIG. 2 and sends a signal which controls the position of the control valve 14 to regulate the flow of temperature control fluid through the heat exchanger 20. For example, if the detected signals fall within Zone I, the control valve 14 is actuated into its open position permitting flow of temperature control fluid to the heat exchanger 20. If the detected signals fall within Zones II or III, then the control valve 14 is actuated into its closed position, preventing flow of temperature control fluid to the heat exchanger 20.

Figure 3A:
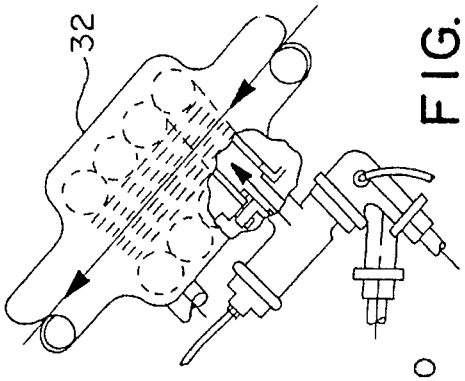
FIG. 3A is a partial side view taken along lines 3A—3A in FIG. 3.
Figure 3:
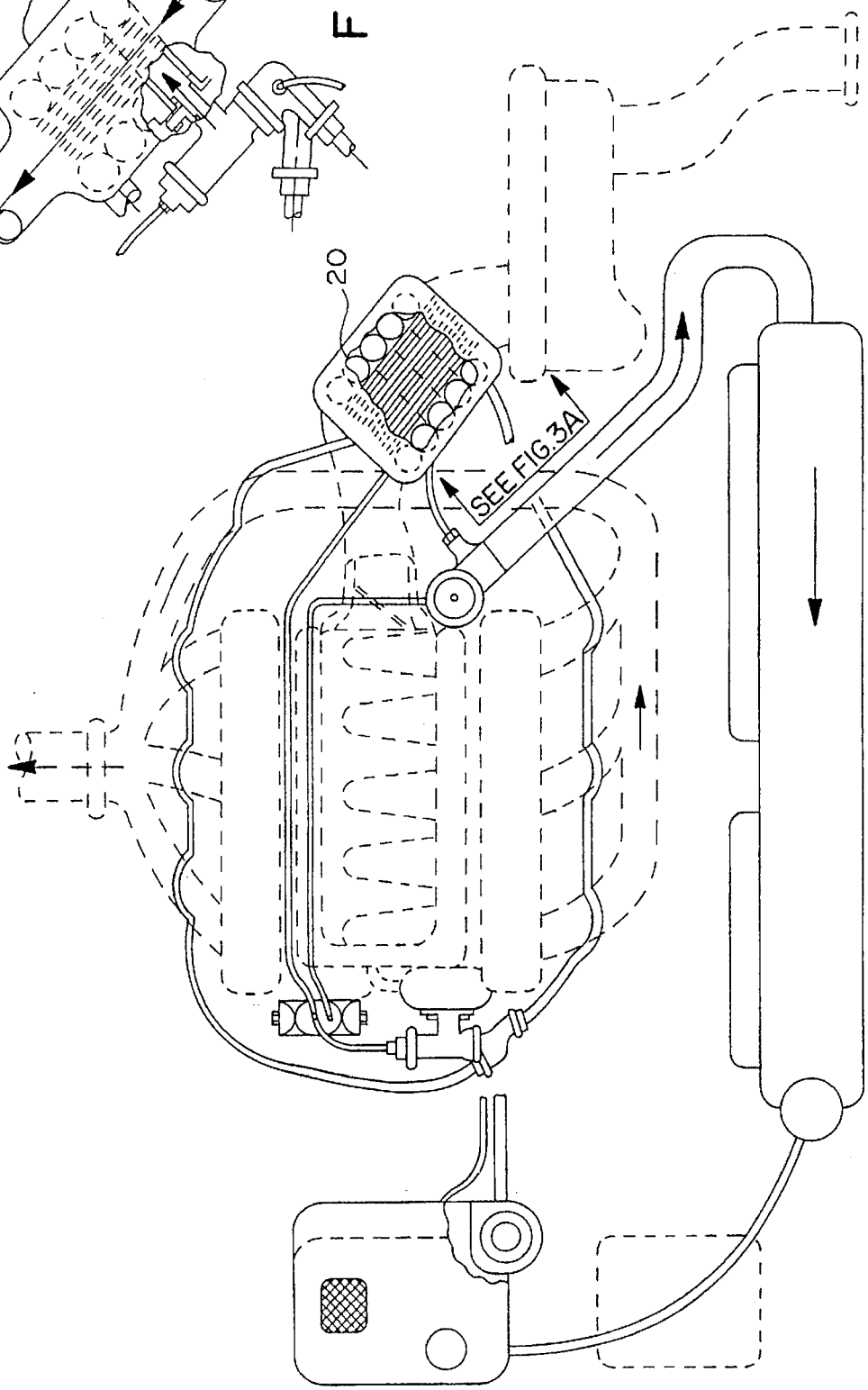
FIG. 3 is a diagrammatical view of an electronic temperature control system, including the system for preheating intake air.

FIGS. 3 and 3A are schematic representations of an electronic engine temperature control system which includes the system for preheating intake air. In that embodiment, the heat exchanger 20 is enclosed in a plastic cover 32 which provides insulation.

Although the heat exchanger 20 in the preferred embodiment consists of a panel of aluminum fins, other types of heat exchangers known in the art may be used in the system. For example, the heat exchanger simply may comprise a length of conduit, disposed in the air flow, of sufficient length for radiating heat to the air. Such a conduit could be straight, coiled, or some other configuration. These and other embodiments will be apparent to persons skilled in the art.

Several variables must be taken into account when designing the heat exchanger 20. For example, the length and other dimensions of the heat exchanger will be determined in part by the anticipated conditions, including the expected ranges of temperatures and flows of the temperature control fluid. These variables will be taken into account by those persons skilled in the art.

The temperature of the heated intake air may be maintained optimally between 120° F. and 130° F. through a secondary system which further regulates the flow of temperature control fluid based on feedback regarding the intake air temperature downstream of the heat exchanger 20. As discussed above, the present invention provides a system for heating the intake air to assist in combustion. When it is determined that the intake air has reached a high enough temperature, the secondary system stops or reduces the flow of temperature control fluid to the heat exchanger 20.

The intake air temperature is detected by a sensor 21 located in the throttle body. However, the sensor 21 may be located anywhere downstream of the heat exchanger 20. The sensor 21 provides a signal to the ECU 30, which produces control signals for regulating the position of control valve 14, which in turn regulates the flow of temperature control fluid through heat exchanger 20.

In one embodiment, the ECU 30 compares the sensed intake air temperature to a predetermined threshold value (e.g., 120° F.). If the sensed intake air temperature exceeds the threshold value, the ECU 30 closes the control valve 14. In an alternate embodiment, the ECU 30 compares the intake air temperature and the sensed engine oil temperature to threshold values (e.g., 120° F. and 220° F. respectively). If both threshold values are exceeded, then the control valve 14 is actuated into its closed position or state.

However, it may be desirable to have a curve, instead of a single threshold value, which controls the state of the control valve 14. It may also be desirable to control the amount and/or rate of flow of temperature control fluid based on intake air temperature. For example, as the intake air approaches a predetermined value (e.g., 120° F.), the rate of flow of the temperature control fluid to the heat exchanger 20 can be reduced.

FIG. 1 includes a schematic representation of the fluid flow paths in the preferred embodiment of the system. The dashed arrows in FIG. 1 illustrate the flow path of the temperature control fluid during normal operation of the engine when the temperature control fluid is relatively hot and the engine is fully warmed. The solid arrows in FIG. 1 illustrate the flow of temperature control fluid during engine warmup/startup.

Based on the above discussion, those skilled in the art would readily understand and appreciate that various modifications can be made to the exemplary embodiments disclosed and are well within the scope of this invention. For example, the temperature control curves themselves may be replaced by one or more equations for controlling the actuation of the valves. In yet another embodiment, fuzzy logic controllers could be implemented for controlling the actuation of the valves and/or varying of the temperature control curves.

Accordingly, although the invention has been described and illustrated with respect to the exemplary embodiments thereof, it should be understood by those skilled in the art that the foregoing and various other changes, omissions and additions may be made therein and thereto, without parting from the spirit and scope of the present invention.

I claim:

1. A system for preheating intake air flowing through an intake manifold of an internal combustion engine including an exhaust manifold, an oil pan, a fuel line, and a water pump adapted for directing a flow of temperature control fluid into the engine, the intake air flow being regulated by a throttle valve in a throttle body located downstream of an air cleaner on the engine, the system comprising:

an exhaust heat assembly located adjacent to the exhaust manifold and adapted to receive a flow of temperature control fluid from the water pump;

a heat exchanger mounted to the engine and disposed within the flow of intake air, the heat exchanger adapted for receiving a flow of heated temperature control fluid from the exhaust heat assembly and for discharging said flow of temperature control fluid into a passageway leading to the oil pan, the heat exchanger including at least one heat exchanging element for transferring heat from the temperature control fluid to the intake air;

a first sensor for sensing an actual engine oil temperature and for providing a signal indicative thereof;

a second sensor for sensing an actual ambient air temperature and for providing a signal indicative thereof;

a control valve for regulating the flow of temperature control fluid to and from said heat exchanger, the control valve having an open state and a closed state; and an engine computer for receiving signals from the first and second sensors, producing control signals based on both of said sensor signals, and sending said control signals to said control valve to control the state of the valve, wherein said control signals are produced in accordance with a set of predetermined values which define a curve wherein said curve is a function of engine oil temperature and ambient air temperature.

2. A system according to claim 1 wherein the heat exchanger is mounted downstream of the throttle body.

3. A system according to claim 1 wherein the heat exchanger is mounted in the air cleaner.

4. A system according to claim 1 wherein the heat exchanger is mounted between the air cleaner and the throttle body.

5. A system according to claim 1 wherein the heat exchanging element for transferring heat from the temperature control fluid to the intake air is a heat conductive tube.

6. A system according to claim 5 wherein the heat conductive tube contains at least one conductor fin.

7. A system according to claim 1 wherein the engine oil temperature is the temperature in the oil pan.

8. A system according to claim 1 wherein the control valve is a solenoid actuated valve.

9. A system according to claim 1 further comprising a third sensor for sensing the temperature of the flow of intake air downstream of said heat exchanger, said third sensor providing a signal indicative of said temperature to said engine computer, the engine computer comparing the signal to a threshold value for determining the desired state of the control valve, the engine computer providing signals to said control valve to place the control valve in the desired state.

10. A method for preheating intake air flowing to an intake manifold of an internal combustion engine, the engine including an exhaust manifold, an oil pan, a water pump adapted for directing a flow of temperature control fluid into the engine, a heat exchanger adapted for receiving a flow of temperature control fluid and for transferring heat from the temperature control fluid to the intake air, and a control valve for regulating the flow of temperature control fluid to and from said heat exchanger, the method comprising the steps of:

detecting the temperature of the engine oil in the engine;

detecting the temperature of ambient air;

comparing the detected engine oil temperature and the detected ambient air temperature to a set of predetermined temperature control values for determining a desired position of the control valve;

actuating the control valve so as to place the valve in the desired position for controlling the flow of the temperature control fluid to the heat exchanger; and directing the temperature control fluid through the heat exchanger to heat the intake air.

11. A method for preheating intake air according to claim 10 further comprising the step of channeling the flow of the temperature control fluid from the heat exchanger into a passageway leading to the oil pan.

12. A method for preheating intake air according to claim 10 wherein the set of predetermined temperature control values define a curve, a portion of which curve has a non-zero slope.

13. A method for preheating intake air according to claim 10 further comprising the steps of:

detecting the temperature of the flow of intake air downstream of the heat exchanger;

comparing the detected temperature of the flow of intake air to a predetermined value for determining a desired position of the control valve; and actuating the control vane so as to place the valve in the desired position for controlling the flow of the temperature control fluid to the heat exchanger.

* * * * *